United States Patent [19]

Rüber et al.

[11] 4,276,682

[45] Jul. 7, 1981

[54] DEVICE FOR LAYING DOWN CONTINUOUS MATERIAL BY MEANS OF A PAIR OF PROFILED ROLLS

[75] Inventors: Klaus Rüber, Wehringen; Karl Zill, Gersthofen, both of Fed. Rep. of Germany

[73] Assignee: Hoechst Aktiengesellschaft, Fed. Rep. of Germany

[21] Appl. No.: 75,142

[22] Filed: Sep. 12, 1979

[30] Foreign Application Priority Data

Sep. 15, 1978 [DE] Fed. Rep. of Germany ..... 2840122

[51] Int. Cl.[3] ..... B65H 54/80

[52] U.S. Cl. ..... 28/289; 19/299; 425/369

[58] Field of Search ..... 425/67, 369; 264/176 F, 264/168; 28/289; 19/299

[56] References Cited

U.S. PATENT DOCUMENTS

| | | | |
|---|---|---|---|
| 345,220 | 6/1843 | Rutishauser | 264/168 |
| 2,086,651 | 7/1937 | Ubbelohde | 264/168 |
| 2,090,669 | 8/1937 | Dreyfus et al. | 264/168 |
| 2,216,142 | 10/1940 | Taylor et al. | 264/168 |
| 2,230,272 | 2/1941 | Slayter | 19/299 |
| 2,729,030 | 1/1956 | Slayter | 264/168 |
| 2,983,026 | 5/1961 | Skalko | 28/289 |
| 3,332,114 | 7/1967 | Oja | 19/303 |

FOREIGN PATENT DOCUMENTS

| | | | |
|---|---|---|---|
| 651347 | 10/1962 | Canada | 19/303 |

*Primary Examiner*—Jay H. Woo

*Attorney, Agent, or Firm*—Connolly and Hutz

[57] ABSTRACT

A device for laying down a continuous material with the aid of a pair of profiled rolls, consisting of two wheels, the peripheries of which are provided with teeth and which form an engagement zone, is provided. The width of the teeth in the engagement zone in the direction of the center point of the wheel remains at the most the same and should increase by no means.

10 Claims, 2 Drawing Figures

DEVICE FOR LAYING DOWN CONTINUOUS MATERIAL BY MEANS OF A PAIR OF PROFILED ROLLS

Figure 1:
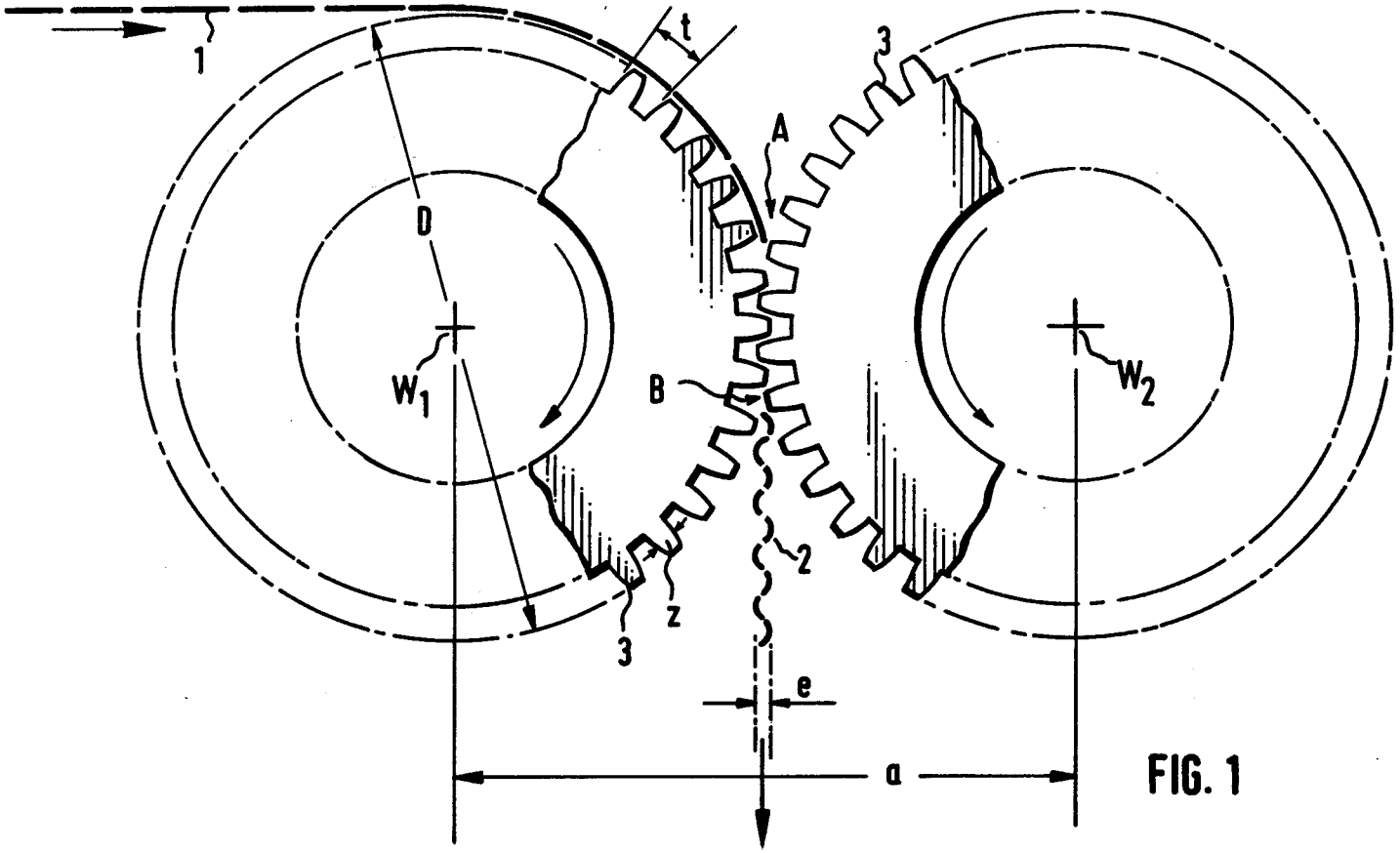

The invention relates to a device for laying down continuous material, such as, for example, a filament tow, with the aid of a pair of profiled rolls.

Devices of this type are used, for example, in the production of synthetic staple fibers when the filament bundles drawn off a relatively large number of meltspinning nozzles are combined to give a tow and are then laid down in large spinning cans.

A number of mechanical and pneumatic processes for laying down the continuously delivered tow have been described; it has been found, however, that these processes are not suitable for the high spinning take-off speeds, such as have become customary in the course of the technological development. The high momentum of the tow must be annihilated instantaneously in these processes when the tow strikes the material already laid down; as a result, the tow opens up, splays and leads to randomization and intertwining of the filaments. When the tow is again drawn out of the spinning can, this type of laying down leads to difficulties in running out and to filament damage and to uneven stretching, and these manifest themselves in deviations in the textile technological data, such as, for example, differences in dyeing. In the most unfavorable case, the tow can, on impingement in the spinning can, even be severely damaged to such an extent that it cannot be processed further.

It is therefore necessary that a laying-down device for tow reduces the speed of the delivered tow before it is laid down in the spinning can. This speed reduction can, for example, be effected by a sinusoidal deformation with the aid of a pair of profiled rolls.

A device of this type is discussed, for example in German Offenlegungsschrift No. 2,609,615, as the state of the art. The profiled wheels of these laying-down elements in most cases have involute toothing which is very common for toothed wheels, since this is insensitive to the change of distance of the shafts of the two profiled wheels, which change is necessary for this application. Triangular teeth, such as are shown, for example, in German Offenlegungsschrift No. 1,435,541, are also known from toothed-wheel crimping.

According to the general view, this laying-down via pairs of toothed wheels has a limit at a maximum delivery speed of the tow of 2,000 m/minute, since otherwise the tow or at least individual filaments of the tow wind around the profiled wheels. This phenomenon is ascribed to the air stream induced by the profiled wheel.

It is the object of the present invention to provide laying-down devices with pairs of profiled wheels, which devices are also suitable for even greater delivery speeds of the tow.

Surprisingly, it has been found that the shape of the teeth has a decisive influence on the maximum speed which is possible without windings being formed on the profiled wheel, even though the air stream generated by the profiled wheel depends only slightly on the shape of the teeth.

The pair of profiled rolls according to the invention consists of two wheels, the peripheries of which are uniformly provided with teeth, the width of the teeth in the engagement zone remaining at most the same in the direction of the center point of the wheel. Preferably, the width of the teeth in the engagement zone remains constant.

The width of the teeth in the engagement zone is preferably less than half, in particular less than a quarter, of the corresponding pitch of the teeth. The engagement is preferably greater than the quotient of the pitch and Ludolph's number $\pi$.

A profiled wheel is in this case a wheel having raises, the so-called teeth, which recur periodically, on its surface and which in particular also have surfaces which are parallel to the axis of rotation of the wheel. In most cases, both the wheels are of the same design.

The tooth width is here the extent of the tooth in the circumferential direction of the profiled wheel, and the pitch of the teeth is the corresponding section of arc between identical points of two adjacent teeth, that is to say the quotient of the circumference of the wheel and the number of teeth. In general, both these values depend on the diameter.

In planes perpendicular to the axes of the profiled wheels, the engagement zone of a pair of profiled wheels is bounded by the two circumscribed circles and, in the view perpendicular thereto, it is bounded by the width of the continuous material.

The invention is explained in more detail by reference to the figures:

FIG. 1 clarifies the terms used. It shows a pair of toothed wheels according to the state of the prior art.

Figure 2:
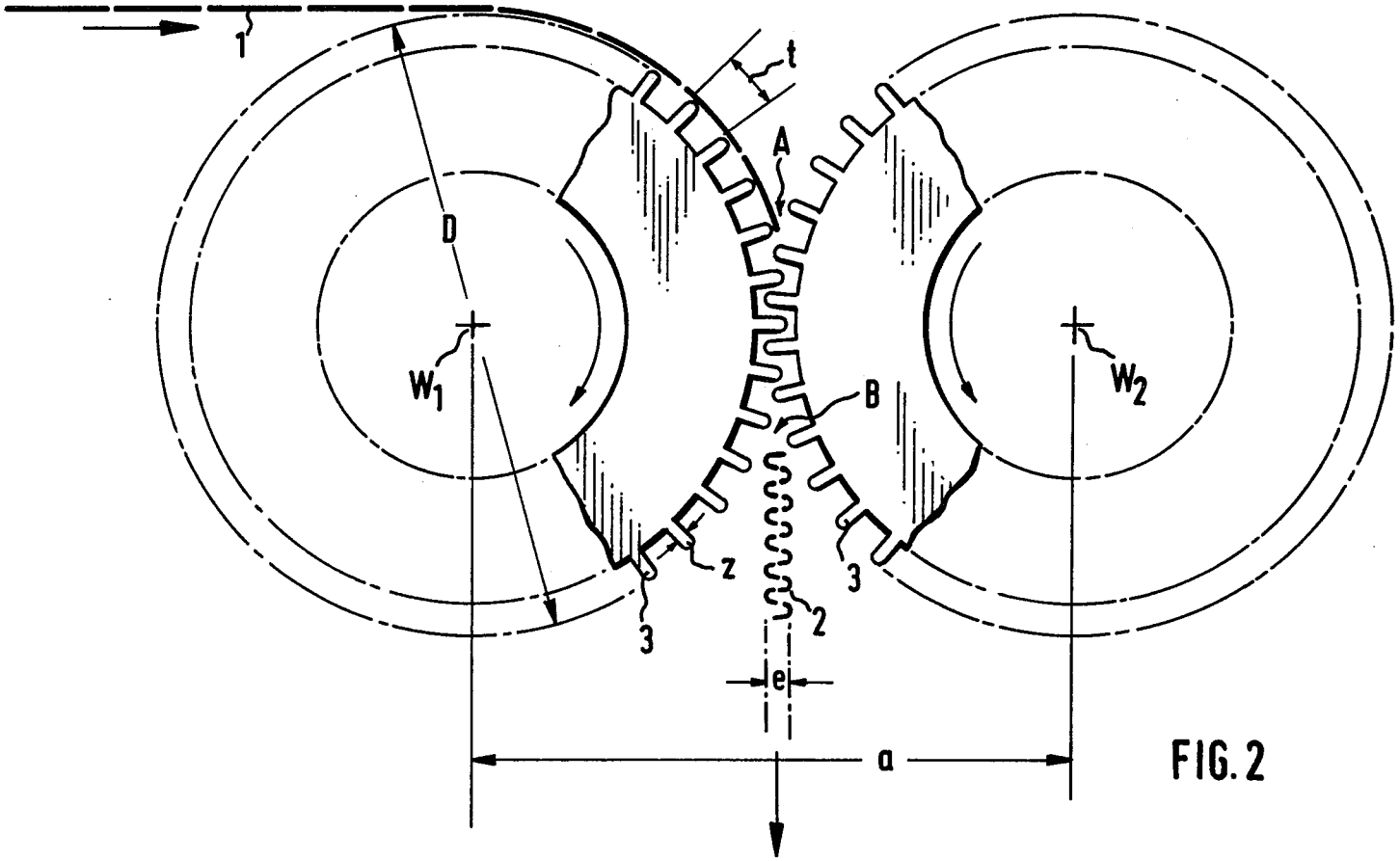

FIG. 2 shows an embodiment of the profiled wheel according to the invention.

In FIG. 1, a tow 1 is gripped at the point A by a pair of profiled rolls according to the state of the art, is deformed between the teeth 3 and is delivered again as an approximately sinusoidally deformed tow 2 at the point B and is laid down in a spinning can. The two profiled wheels have a diameter D of the circumscribed circle, and the distance a of their shafts $W_1$ and $W_2$ is smaller than the diameter of the circumscribed circle so that an engagement zone e results between the points of intersection A and B of the circumscribed circles.

In the involute toothing shown here, the tooth width z in its greatest extent on the center line is half the pitch t of the teeth, and the theoretically possible engagement without tow is here the pitch t of the teeth divided by Ludolph's number $\pi$.

FIG. 2 shows a profiled wheel according to the invention, having teeth 3, the width z of which is kept constant, independently of the distance of the axis. In most cases, the teeth are rounded on the outer edge in order to avoid damage to the tow. In this example, the pitch t of the teeth is about five times the tooth width z.

Teeth, the width of which decreases towards the axis of the wheel, are used less frequently for reasons of strength.

High spinning speeds require a correspondingly great speed reduction in order still to ensure useful laying-down in the spinning cans.

Experiments show that the engagement has a greater influence on the speed reduction than has the number of the teeth. For geometrical reasons, however, the engagement and the number of teeth cannot be arbitrarily increased.

It has now been found that, in the case of wheel diameters of about 500 mm and about 40 teeth, involute toothing according to the state of the art allows engagements of only about 5 to 10 mm, and this leads to a speed reduction of only 10–15%.

Profiled wheels according to the invention, such as are shown say in FIG. 2, already allow engagements of about 15 mm, and hence a speed reduction of about 25%, with similar dimensions.

In order to keep the friction of the tow on the teeth low, teeth with surfaces having a low friction coefficient are selected, such as, for example, surfaces of dull-finished chromium or of sintered ceramics. The friction can also be kept low by the choice of the dressing agents and of the water content of the tow.

A large diameter of the profiled wheels is selected in order to be able to use a device which is inexpensive due to low speeds of rotation. However, centrifugal forces also contribute to the detachment of the tow from the teeth so that, with higher engagements, lower wheel diameters are again more suitable.

The number of teeth and the wheel diameter as well as the specific shaping of the teeth are adapted, within the scope of the present invention, to the particular problem, the nature of the spun material, the applied dressing, the individual and total denier of the tow and, of course, the spinning take-off speed being taken into account. Thus, for example, the tow thickness also limits the maximum possible engagement of the two profiled wheels.

The Example shows the effect of a device according to the invention and its advantages compared with the state of the art.

EXAMPLE

A polyethylene terephthalate tow having a total denier of 8,000 tex and an individual denier of 3.6 dtex was laid down in spinning cans by a pair of profiled rolls according to the invention, in accordance with FIG. 2, at a delivery speed of 2,300 m/minute.

The pair of profiled rolls consisted of two identical wheels of 520 mm diameter, the number of teeth was 60, the tooth width was 4 mm and the tooth height was 25 mm. With an engagement of 10 mm, the speed reduction was 15%. No formation of windings was observed at all on the pair of profiled rolls.

The advantages of the pair of profiled rolls according to the invention, as compared with the state of the art, manifest themselves in particular in the improved running-out of the tow from the spinning can at the sliver-drawing line: Tows laid down according to the invention gave rise to 0.3 fault per 1 tonne of tow, compared with 0.7 fault/l tonne in the case of pairs of profiled rolls according to the state of the art, having involute toothing, a diameter of 520 mm, a number of teeth of likewise 60 and an engagement of 4 mm; in this case the speed reduction was only 5%.

We claim:

1. A device for laying down in spinning cans a tow of filaments with the aid of a pair of profiled rolls, comprising delivery means supplying the tow at a delivery speed to the pair of profiled rollers, the profiled rolls having peripheries which are uniformly provided with teeth having a pitch and which form an engagement zone, the width of the teeth in the engagement zone of the pair of profiled rolls being at least the same in the radial direction outwardly from the center point of each roll and a small fraction of the pitch of the teeth, the profiled rolls having drive means rotating them at a laying-down speed at which the tow is laid down in the spinning cans, and the laying-down speed being reduced relative to the delivery speed by over 15% without winding up around the profiled rolls.

2. A device as claimed in claim 1, wherein the width of the teeth in the engagement zone remains constant.

3. A device as claimed in claim 2, wherein the width of the teeth in the engagement zone is less than half the corresponding pitch of the teeth.

4. A device as claimed in any one of claims 1, 2 or 3, wherein the width of the teeth is less than a quarter of the corresponding pitch of the teeth.

5. A device as claimed in any one of claims 1, 2 or 3, wherein the engagement is greater than the quotient of the pitch of the teeth and Ludolph's number $\pi$.

6. A process for laying down in spinning cans a tow of filaments with the aid of a pair of toothed rollers having a pitch and an engagement zone comprising the steps of delivering the tow at a delivery speed to the engagement zone beteeen the teeth of the toothed rollers, maintaining the width of the teeth at least the same in the radial direction outwardly from the center of each roller and at a width which is a small fraction of the pitch, driving the rollers at a laying-down speed in the spinning cans which is reduced relative to the delivery speed by over 15% without winding up around the rollers.

7. A process as set forth in claim 6, wherein the width of the teeth in the engagement zone is maintained less than half the pitch of the teeth about the rollers.

8. A process as set forth in claim 7, wherein the width of the teeth is maintained less than a quarter of the pitch of the teeth about the rollers.

9. A process as set forth in any one of claims 6, 7 or 8, wherein the engagement is maintained greater than the quotient of the pitch of the teeth and Ludolph's number $\pi$.

10. A process as set forth in claim 6, wherein the laying-down speed is reduced from over 15% to up to about 25% of the delivery speed.

* * * * *